US006131929A

United States Patent [19]

Haley

[11] Patent Number: 6,131,929

[45] Date of Patent: Oct. 17, 2000

[54] PORTABLE MODULAR CART AND GAME TABLE

[76] Inventor: Reginald J. Haley, 1030 Cumberland Rd., Waldorf, Md. 20602

[21] Appl. No.: 09/099,203

[22] Filed: Jun. 18, 1998

[51] Int. Cl.[7] ..... B62B 3/00

[52] U.S. Cl. ..... 280/47.34; 4/619; 296/22

[58] Field of Search ..... 280/47.34, 47.35, 280/79.11; 108/13, 179; 296/22; 273/283, 284; 4/619, 631

[56] References Cited

U.S. PATENT DOCUMENTS

| | | | |
|---|---|---|---|
| D. 188,315 | 7/1960 | Frick | 296/22 |
| 572,688 | 12/1896 | Seifert | 273/284 |
| 2,520,543 | 8/1950 | Hawkins | 108/25 |
| 3,983,583 | 10/1976 | Herman et al. | 4/167 |
| 4,574,407 | 3/1986 | Didia | 4/619 |
| 4,924,782 | 5/1990 | Nichoalds | 108/27 |
| 5,360,264 | 11/1994 | Crane | 312/293.1 |
| 5,502,848 | 4/1996 | Cowan | 4/619 |
| 5,526,539 | 6/1996 | Bower et al. | 4/619 |
| 5,833,295 | 11/1998 | Farlow, Jr. | 296/22 |
| 5,881,404 | 3/1999 | Knight | 4/619 |

*Primary Examiner*—J. J. Swann
*Assistant Examiner*—James S. McClellan
*Attorney, Agent, or Firm*—Blank Rome Comisky & McCaulev LLP

[57] ABSTRACT

A portable, modular service cart that is readily converted to a refreshment center, game table or vanity is disclosed. The cart generally comprises a mobile unit having a horizontal tray and legs extending downward from corners thereof. The legs have casters located at lower ends thereof and comprise telescoping members for permitting adjustment of tray height. The tray has an upper surface with a sink and multiple wells provided therein, with some or all of the wells being removable and/or refrigerated. A collapsible faucet extends beyond the upper surface of the counter and includes a first end that extends over the sink and a second end that rests beneath the upper surface of the counter and is coupled to a water supply line. The water supply line is connected at an opposite end to a continuous, endless water source such as an outdoor faucet or spigot. A water filtering system is preferably secured to one of the legs of the mobile unit. A cover for overlying the entire upper surface of the tray is hingedly connected to the tray. The cover is deep and includes pockets, racks, straps and the like for safely securing bottles, utensils and other objects thereto. When the cover overlies the tray, the faucet is urged downward, causing the second end thereof to retract further beneath the upper surface of the tray. The flat top of the cover is a game board, such that when the cover is closed the cart is converted to a game table. In another embodiment, a mirror is provided along one or both surfaces of the top of the cover for independent living aid applications.

20 Claims, 3 Drawing Sheets

PORTABLE MODULAR CART AND GAME TABLE

FIELD OF THE INVENTION

The present invention relates to versatile service apparatus that can be as a vanity, or converted for storing, dispensing and serving beverages and food items, and more particularly to a portable cart having an adjustable height, a built-in water purification system, portable modular trays, and a cover rotatably connected to the serving surface for storing bottles and for converting the cart into a game table.

BACKGROUND OF THE INVENTION

Heretofore, mobile carts have been designed to meet a distinct and singular need. For example, U.S. Pat. No. 5,233,735 to Reginald Haley, the inventor of the apparatus described and claimed herein, discloses an embalming instrument cart for use in embalming human remains. The cart has trays for storing chemicals and embalming instruments and an irrigation system. Portable carts are also typically used by health care professionals during surgical procedures, by airplane stewards, and by food service providers, including street vendors and caterers.

When entertaining guests outdoors or in one's home, it is important to have an adequate supply of filtered water readily available for guests to consume. Water is also needed for cleaning glasses and utensils and for hand washing. The demand for water is a considerable concern for hosts in situations where beverages and snacks are served outside of the kitchen. Selecting an appropriate location for setting up a serving station is difficult, as guests typically congregate in multiple areas that are constantly subject to change as the result of weather or shifts in activities. It is therefore desirable to have portable service carts available that carry an adequate supply of fresh water.

To meet the service demands encountered when entertaining outdoors, numerous portable beverage dispensing apparatus have been developed. Typical portable dispensing apparatus are disclosed in U.S. Pat. Nos. 4,974,500, 4,076,349, 3,949,902, 3,889,967 and 3,748,437.

The patents referenced above disclose apparatus that perform a single function and include large, heavy water supply tanks or no water supply at all. According to the apparatus disclosed in U.S. Pat. No. 4,974,500, a hot beverage preparation and dispensing cart includes a large, enclosed unit housing an internal water supply and collection system and a complex power distribution system. The water supply and collection system includes a holding tank positioned at a bottom of the cart, sink and beverage preparation stations located in the counter top, a filter inserted in the feed lines extending between the holding tank and the sink and beverage stations, a hot water heater, and a collection tank. A canopy having an illuminating means provided therein is spaced from and extends over the two-level counter top.

According to the apparatus disclosed in U.S. Pat. No. 4,076,349, a mobile beverage dispensing cart includes a large, rectangular-shaped cabinet structure having a counter top with multiple units, including a hot liquid storage and dispensing means, a cold liquid dispensing means and a condiment means, removably secured thereon. The cart converts to a flat surface service cart with multiple drains and wells provided therein by removing the units from the counter top and rotating upward the side shelves hingedly attached to the sides of the cart.

According to the apparatus disclosed in U.S. Pat. No. 3,889,967, a patio serving cart includes a wheeled frame having a top with two wells disposed side by side. A cover having a vent provided therethrough is hinged to the upper surface of the frame such that the cover overlies only the portion of the top having the wells disposed therein when the cover is closed. No water supply means is contemplated.

Service carts, such as the ones described above, are relatively expensive items having limited uses. Homeowners who entertain small weekend gatherings are less inclined to purchase the commercial, unifunctional and extravagant portable serving devices. Further, on board water tanks included with many existing carts provide inadequate amounts of fresh water and significantly increase the weight of the cart, thereby limiting portability and maneuverability. It would be beneficial to have a service cart that is tailored for the casual weekend entertainer, that has multiple uses aside from food and beverage service, and that is lightweight while still meeting the fresh water supply needs of any occasion.

It would be desirable to provide a cost-effective, high-quality, portable cart that provides an endless supply of filtered water, is easily adjusted and covered without removing any components thereof, and is readily converted to an apparatus having a separate and unique application or use. No such versatile service cart is commercially available.

SUMMARY OF THE INVENTION

The present invention is directed to a versatile service cart that is readily converted to a game table or vanity. The cart includes a mobile unit having a horizontal tray and legs extending downward from corners thereof. Wheels or casters are located at lower ends of the legs. Means are provided along the legs for adjusting the height of the tray. A water delivery and filtration system is also incorporated. A cover having a game board connected to, painted on, or otherwise integral with its outer surface is rotatably connected to the tray and overlies the tray, with its outer surface exposed, when the cover assumes its closed position.

The present invention is lightweight and is easily rolled between locations. Each of the legs is preferably formed from a pair of telescoping members, with locking pins or other similar means being provided for fixing the legs, and hence the tray, at desired positions. The tray lies in a plane that is generally parallel to the underlying surface on which the cart rests. The tray, which includes multiple compartments, can be removed and replaced with an alternative tray, such as for a vanity. The compartments of the tray are removable and located in the upper surface of the tray. One of the compartments is preferably a sink or basin. Other compartments for storing or holding a variety of diverse items are also included.

The cart is equipped with a water delivery and filtration system for providing a continuous supply of purified drinking water. The system includes a faucet extending upward from the upper surface of the tray. The faucet, which is preferably J-shaped, has an inlet located beneath the upper surface of the tray and an outlet which is situated above the tray's upper surface and opens downward into a sink. Knobs for controlling water flow are provided on opposite sides of or adjacent to the faucet. An inlet line having one end connectable to an endless source of water, such as a spigot or a faucet, and a second end connected to the inlet of the faucet is also included. A water purification system is attached to the mobile unit.

A cover is connected to the tray and is movable between a closed position, where the cover overlies the upper surface of the tray, and an open position. No components of the mobile unit need be removed to accommodate the cover, as the faucet collapses when the cover is in its closed position. Preferably, the faucet is retractably located in the tray, such that when the cover is closed, the entire faucet moves downward. When the cover is rotated to its open position, the faucet returns to its upright, fully extended position.

The cover is hingedly connected to the tray and includes a top and side walls extending from side edges of the top. The side walls and inner surface of the top define a storage area. Securing means, such as pockets, racks and straps, are located in the storage area along inner surfaces of the side walls, top or both, for removably securing items therein. The storage area is relatively deep and has dimensions for storing bottled beverages and similarly sized items. For living aid applications of the present invention, a mirror overlies the inner surface of the top, with means for securing brushes, toiletries and similar items, provided along the inner surfaces of the side walls.

The components of the portable cart are interchangeable, thereby allowing the user to vary the use and purpose of the cart. For example, the entire tray, as well as the individual compartments in the upper surface of the tray, are removable and may be selected for their ability to hold particular items, e.g., eating utensils, cosmetics, gardening tools, etc. In fact, the portable cart can be configured to serve recreational, medical and health and hygienic applications, among others, and is easily reconfigured as a wet bar, a living aid, a physician's table and the like. The inclusion of a cover for overlying the upper surface of the tray further increases the versatility and usefulness of the cart.

The outer surface of the top of the cover has a game board provided thereon. The game board can be a painted surface or a separate structure connected to the top. Any board can be applied, including, but not limited to, a backgammon board, a chess board and a checker board.

Advantageously, the present invention has multiple utilities and is readily adapted for a different purpose without disassembly. When oriented as a wet bar, one can roll the cart to a desired location and serve cold drinks, including fresh water, wash glasses and clean fruit and utensils on the spot. No additional carts or tables are needed, as a generous supply of beverages are stored in the deep cover and the rack extending beneath the tray between the legs of the unit. By using a remote (and virtually endless) water supply, there are no limitations on water use. Further, as there is no need for a water tank on board, the weight of the cart is substantially reduced, a feature that greatly enhances the mobility of the unit. Importantly, that increase in mobility is not at the expense of water quality, as an on-board water filter provides for drinking water this is comparable to bottled water in terms of purity and taste. To convert the cart to a game table, one need only rotate the hinged cover until it overlies the upper surface of the tray. All fixtures protruding from the upper surface of the tray, except for the faucet, are received within the deep cover without changing position or being removed. The faucet collapses as the cover rotates to its closed position. Specifically, the entire faucet moves downward, with the lower end thereof moving deeper beneath the upper surface of the tray and the upper end thereof moving closer to the tray's upper surface. When fully closed, the top of the cover lies in a plane that is generally horizontal to the upper surface of the tray, with the game board ready for use. The telescoping legs are then readily adjusted to accommodate the height or playing positions (i.e. sitting, standing) of the players.

With the foregoing and other objects, advantages and features of the invention that will become hereinafter apparent, the nature of the invention may be more clearly understood by reference to the following detailed description of the invention, the appended claims and to the several views illustrated in the attached drawings.

DETAILED DESCRIPTION OF THE INVENTION

Figure 1:
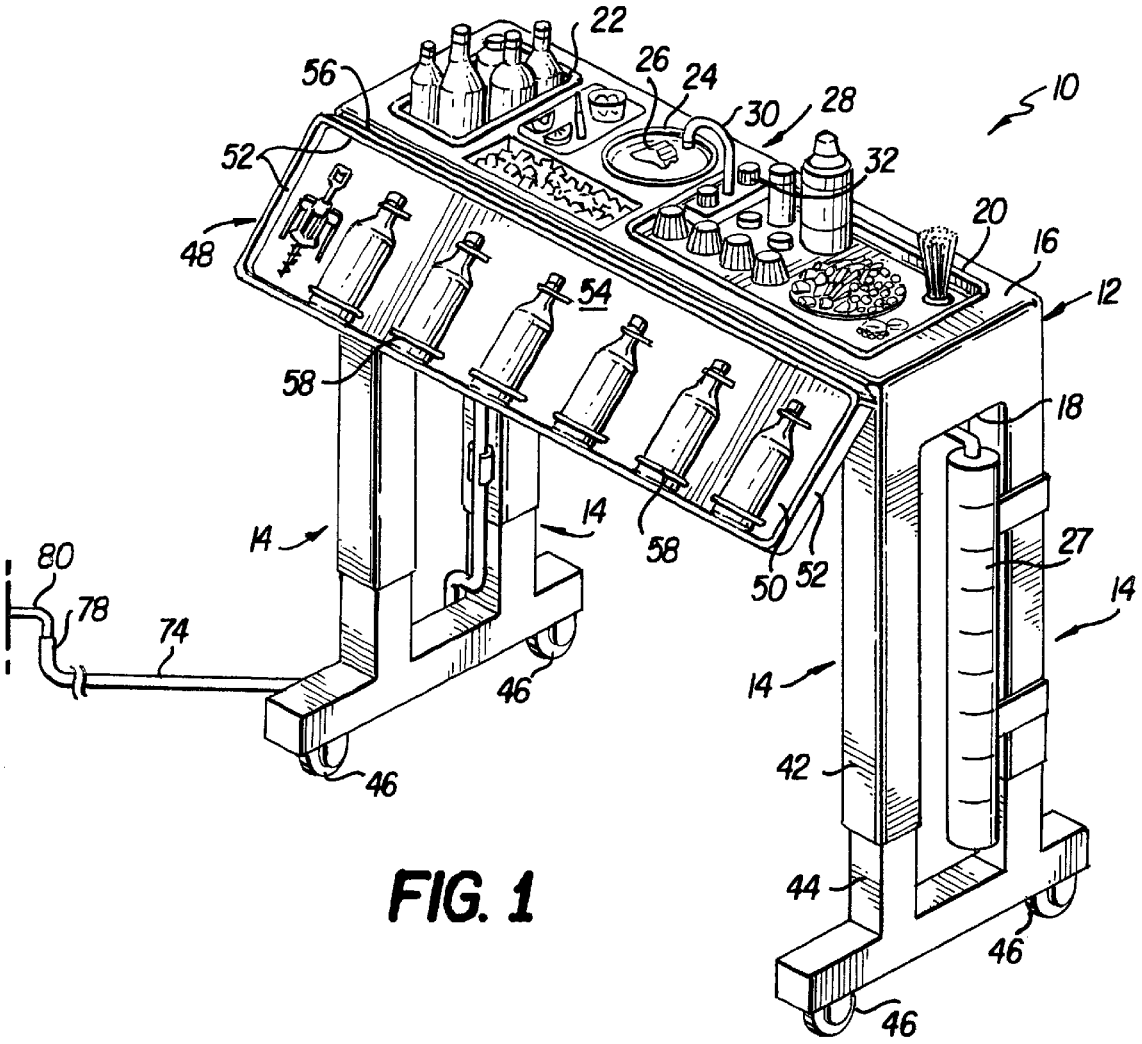
FIG. 1 is a front perspective view of the present invention.

Referring now in detail to the drawings, wherein like elements are identified by like reference numerals throughout, there is shown in FIG. 1 a perspective view of the portable cart of the present invention which is designated generally by the reference numeral 10. Portable cart 10 includes a generally horizontal tray 12 and legs 14 extending downward from corners thereof. The tray 12, which may be removable and preferably has a rectangular shape, has an upper surface 16 and a lower surface 18. Legs 14 extend downward from the lower surface 18 and may be formed integrally therewith. The upper surface 16 of the tray 12 has multiple openings 20 of various shapes, sizes and depths provided therein for receiving removable containers 22 or surfaces. In alternative embodiments, the containers 22 may be permanently connected to the tray 12 or formed integrally with the upper surface 16 thereof. The containers 22, which are preferably made of plastic, have divided sections and means for holding various items. A refrigeration device (not shown) is provided for maintaining the items of selected compartments at low temperatures.

The upper surface 16 of the tray 12 has a generally circular opening for receiving a sink 24. The sink 24 is made of plastic, metal or ceramic and includes an open drain 26 with a conventional stopper. A water disposal means, such as a collection container 27 or an effluent line, is in communication with the drain for collecting water and the like which passes through the drain 26.

The tray 12 also has openings provided along its upper surface 16 for accommodating plumbing fixtures 28, including a faucet 30 and water control knobs 32. The faucet 30 has a conventional inverted "J" shape with its outlet end 34 extending over the sink 24 and its inlet end 36 located beneath the upper surface 16 of the tray 12. The faucet 30 is secured for rotational and axial movement. Preferably, the faucet 30 is rotatable 360 degrees and is collapsible. Hot and cold knobs 32 are located adjacent the faucet 30, preferably on opposite sides thereof, for controlling water discharge from the faucet 30.

Figure 3:
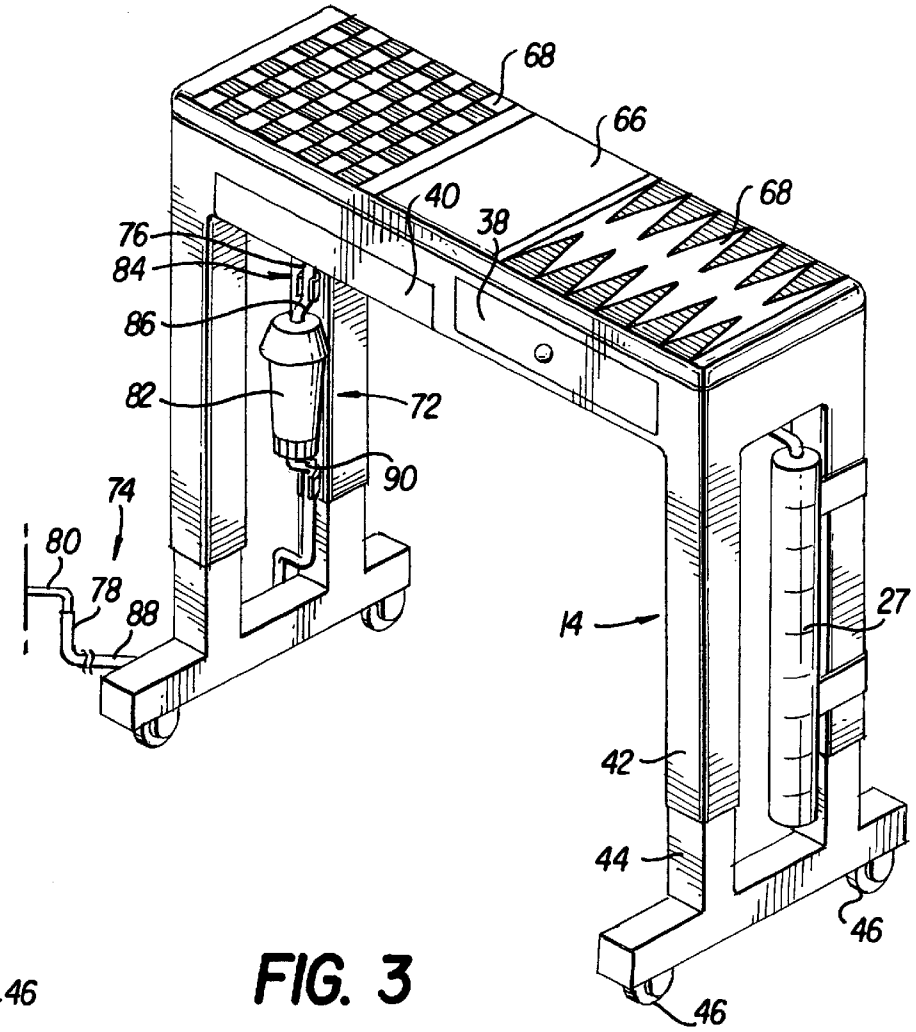
FIG. 3 is a front perspective of the apparatus of FIG. 1 wherein the cover is closed and the apparatus is converted to a game table.

As shown in FIG. 3, the tray 12 further includes a drawer 38 slidably received therein and a light source 40, such as a fluorescent lamp, mounted with a recess defined on the front face of the tray 12.

The legs 14 of the cart 10 are made of any acceptable material, such as plastic, wood or metal, and are adjustable for allowing the height of the tray 12 to be varied. As shown in the figures, each leg 14 is adjustable independent of the others and includes a pair of telescoping members 42,44. The telescoping members 42,44 are fixed in position by any acceptable locking device, such as locking pins. Casters 46 or other rollers are mounted to the bottom of the lower telescoping members 44 to provide the cart 10 with mobility.

It should be understood that numerous variations of the embodiments of the tray 12 and legs 14 discussed above are contemplated. For example, the tray 12 and legs 14 can be constructed as a one piece unit, with the legs 14 integrally connected to the lower surface 18 of the tray 12. The legs 14 may include means, such as hinged sections, that provide for limited, as opposed to infinite, adjustment of the height of the tray 12. The tray 12 may also be supported by less or more than four legs or any other suitable support.

The portable cart 10 is further equipped with a cover 48. The cover 48 includes a top 50 and side walls 52 extending from edges thereof. A storage area 54 is defined by the inner surfaces of the top 50 and side walls 52. In its closed position, the cover 48 overlies the entire upper surface 16 of the tray 12.

As shown in FIG. 1, the cover 48 is preferably hinged 56 along one end thereof to a side edge of the tray 12 so as to pivot between an open and closed position. Any acceptable connecting means, such as folding hinges or living hinges, may be used.

Figure 5:
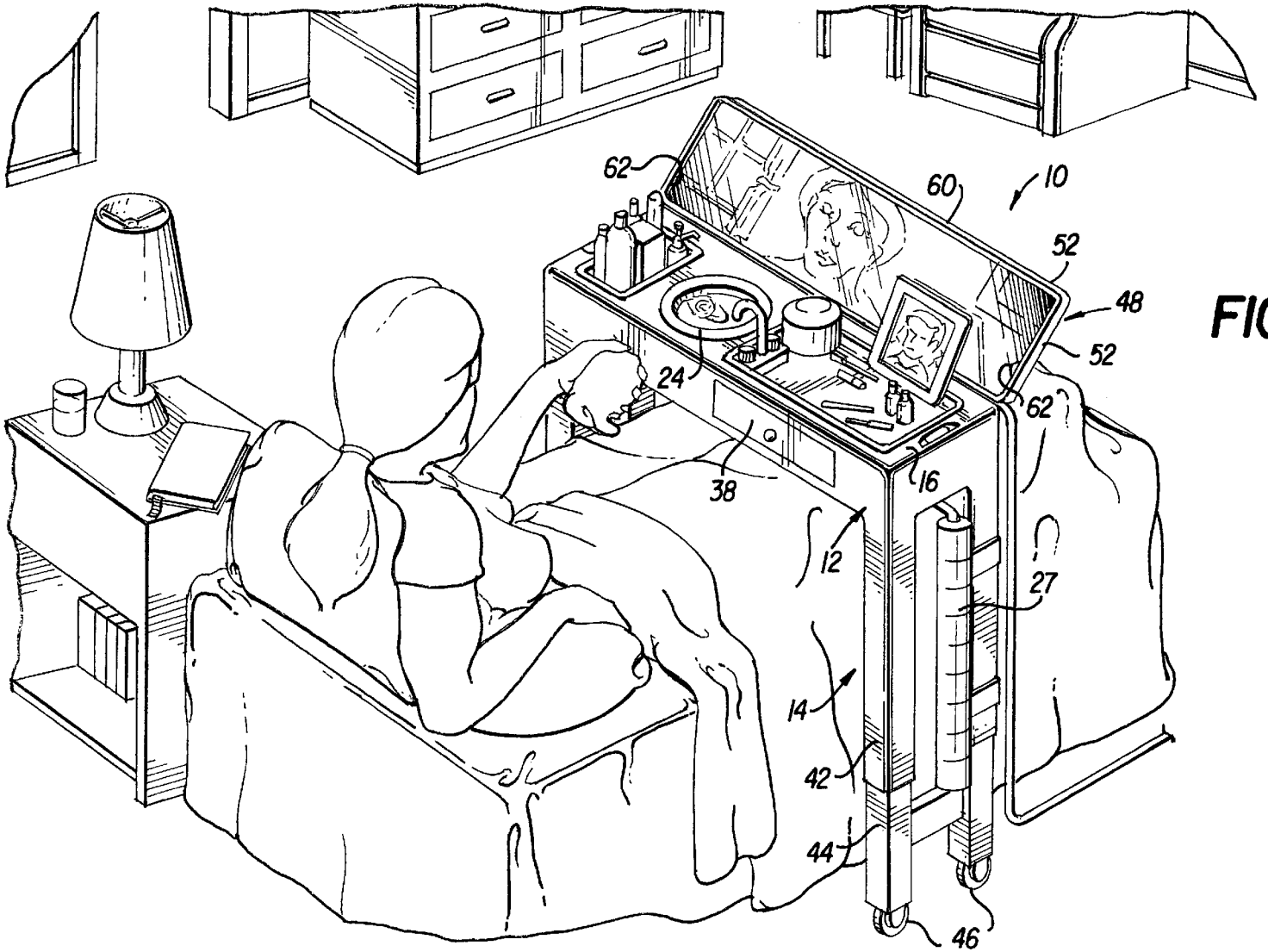
FIG. 5 is front perspective view of another embodiment of the present.

Referring to FIG. 1, the storage area 54 defined by the top 50 and side walls 52 of the cover 48 is accessible when the cover 48 is in its open position. Securing means 58, such as straps and pockets, are located in the storage area 54 for holding objects therein. The securing means 58 should be capable of retaining the objects thereto and limiting movement of the objects when the cover 48 is rotated between open and closed positions. For wet bar applications of the present invention, the depth and width of the storage area 54 is large enough to accommodate bottled beverages. Cover 48 may, if desired, be molded out of plastic, e.g., polyurethane, with recesses for receiving and storing bottles or other objects. For vanity table embodiments of the cart (FIG. 5), a mirror 60 is located along the inner surface of the top 50, with hooks 62 and the like for holding brushes, cosmetics, etc. located along the inner surfaces of the side walls 52.

As shown in FIG. 3, the cart 10 is converted to a game table simply by rotating the cover 48 to its closed position. In its closed position, the side walls 52 of the cover 48 are flush with the side walls of the tray 12. No part of the upper, or serving, surface 16 of the tray 12 is exposed. The outer surface 66 of the top 50 of the cover 48 has one or more game boards 68, such as a checker board and a backgammon board, provided thereon. Each game board 68 can be a sheet of paper, cardboard, or the like with a playing surface printed thereon adhered or mounted to the outer surface 66 of the top 50, or can be directly applied, e.g. printed, to the outer surface 66 of the top 50. The game boards 68 are either interchangeably attached or permanently affixed to the cover 48. Game pieces are stored in the drawer or in the storage area 54 defined by the cover 48.

Figure 4:
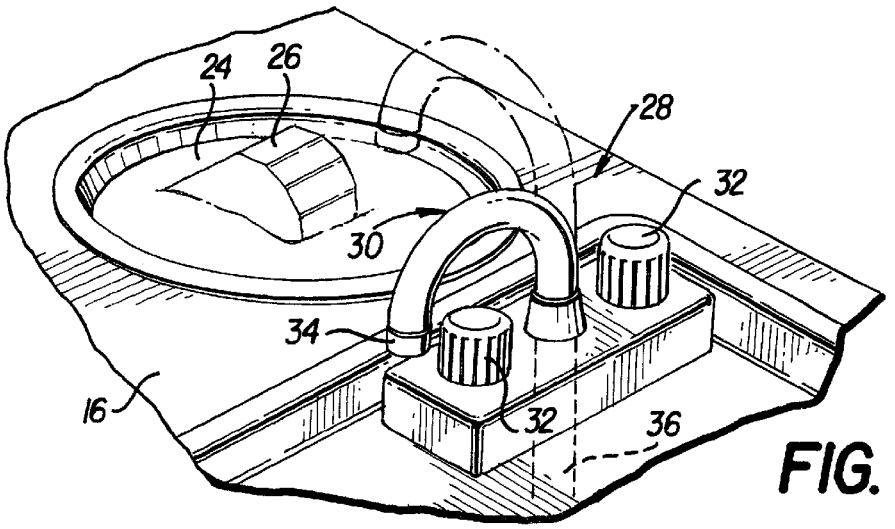
FIG. 4 is an enlarged detail A of FIG. 1 showing the retractable faucet.

The cover 48 is rotated to its closed position without removing or rearranging any components of the cart 10 protruding from the upper surface 16 of the tray 12. The cover 48 has a depth large enough to accommodate all fixtures except for the faucet 30. The faucet 30, however, collapses when the cover 48 is closed. As shown in FIG. 4, the faucet 30 is retractably located in the tray. When the cover 48 is open, the faucet 30 assumes a fully extended, upright position. When the cover 48 is closed, the entire faucet 30 moves downward, with the outlet end 34 of the faucet 30 moving closer to the upper surface 16 of the tray 12 and the inlet end 36 moving deeper into the tray 12, i.e. further beneath the upper surface 16. Vertical movement of the faucet 30 is instituted directly by a force applied by the cover 48 or indirectly by a position control mechanism in communication with the cover 48. When the cover 48 once again assumes its open position, the faucet 30 is either manually or automatically returned to its fully extended position.

There are numerous means for retractably securing the faucet 30 to the tray 12. In one embodiment, a mating means, such as one or more projections or clasps, are located along the surface of the faucet beneath the upper surface of the tray. The mating means engage complementary mating means provided along the under surface of the tray and secure the faucet in its fully extended position. To collapse the faucet, a downward force capable of causing the mating means to disengage is applied thereon. Once the mating means are released, the faucet is moved downward. Restoring the faucet to its upright position involves pulling up on the faucet until the mating members lock together. In another embodiment, axial movement of the faucet is controlled by an elastic member or the like extending between the cover and either the faucet or an intermediate member or assembly which communicates with the faucet. Numerous other variations are contemplated.

Figure 2:
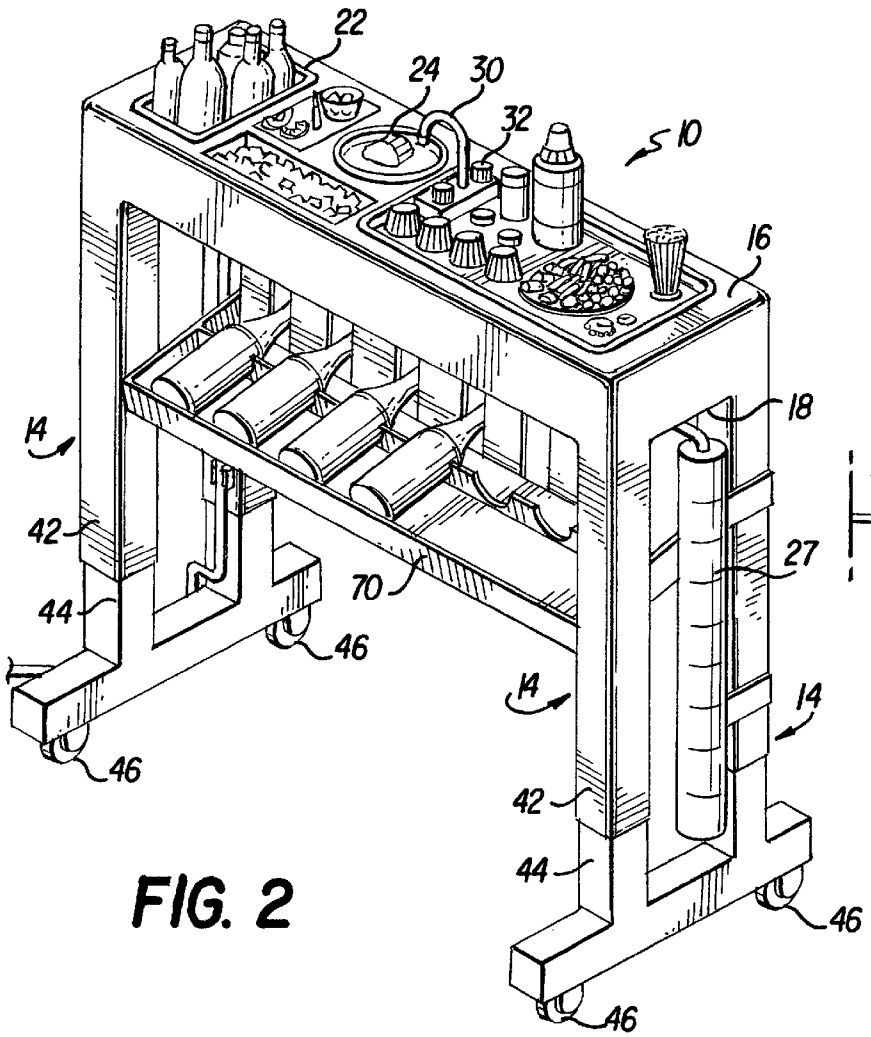
FIG. 2 is a front perspective view of the apparatus of FIG. 1 having the cover removed and a rack positioned between and connected to the legs of the frame.

Referring to FIG. 2, the portable cart 10 includes one or more storage structures 70, such as a rack, disposed beneath the tray 12. Each structure 70 is secured to one or more of the legs 14. As shown in FIG. 2, the structure 70 may be a wine rack having ends thereof secured to the four legs 14 of the cart 10. It is understood that storage structures 70 of various sizes, styles and functions may be located beneath the tray 12 and are considered to be under the scope of the present invention.

Referring to FIG. 3, the portable cart 10 includes a water delivery system 72 for supplying an endless supply of filtered water. The water delivery system 72 includes an influent line 74, preferably one or more lengths of tubing, having a first end 76 connected to the inlet end 36 of the faucet 30 and a second end 78 connected to a remote water source 80, such as an outdoor spigot or faucet. The influent line 74 attaches to the cart's water filtering system 82 for purifying the incoming water.

As shown in FIG. 3, the influent line 74 includes a short section 84 for connecting the outlet end 86 of the filtering system 82 to the inlet end 36 of the faucet 30, and a long section 88 for connecting the remote water source 80 to the inlet end 90 of the filtering system 82.

While the portable cart can have any suitable dimensions, a preferred embodiment of the cart includes a tray that is four feet long, two feet wide and eight inches deep, a cover that is four feet long, two feet wide and at least two inches deep, and adjustable legs that support the tray between two to four feet above the underlying surface. The cart is preferably constructed of lightweight materials that are chemical and weather resistant.

From the foregoing, it should be readily apparent and appreciated by those skilled in the art that the present invention provides a particularly advantageous, economical portable service cart that not only addresses the clean water supply and storage needs unresolved by prior art apparatus but also provides multifunctionality, namely, convertible uses as a game table, without disassembling any components of the cart.

Although certain presently preferred embodiments of the invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. A combination beverage cart/game table apparatus comprising:

a mobile cart having a generally horizontal tray with an upper surface and a lower surface, legs extending from said lower surface of said tray, said legs having upper ends connected to said tray and lower ends, and casters located at said lower ends of said legs;

a water delivery system having a faucet extending upward from said upper surface of said tray, said faucet having an inlet and an outlet, an inlet line having a first end connected to a remote water source and a second end connected to said inlet of said faucet, and a sink positioned in said upper surface of said tray, said water delivery system further comprises a water filtering system;

a game board connected to said tray of said cart and movable between a first position and a second position, said board having a first side with a playing surface provided thereon;

wherein said game board overlies said upper surface of said tray in said first position, with said playing surface of said tray being exposed.

2. Apparatus according to claim 1, wherein said filtering system is connected to said cart.

3. Apparatus according to claim 1, wherein said game board is hingedly connected to said tray.

4. Apparatus according to claim 1, wherein said playing surface is selected from the group consisting of a backgammon board, a checker board, a chess board, and combinations thereof.

5. Apparatus according to claim 1, wherein said legs are telescoping.

6. Apparatus according to claim 1, further including:

a cover connected to said tray and movable between a first position wherein said cover overlies said upper surface of said tray, and a second position;

wherein said cover further comprises means for securing objects thereto.

7. Apparatus according to claim 6, wherein said cover further comprises a top having an outer surface, an inner surface, a front edge, a back edge, and side edges, walls extending from said front, rear and side edges, said walls enclosing said inner surface of said top, and wherein said securing means is located along at least said inner surface of said top.

8. Apparatus according to claim 7, wherein said wall extending from said back edge of said top is hingedly connected to said tray.

9. Apparatus according to claim 7, wherein said cover has a depth of at least four inches.

10. Apparatus according to claim 7, further comprising a mirror connected to and overlying said inner surface of said top.

11. Apparatus according to claim 6, wherein said faucet is collapsible.

12. Apparatus according to claim 6, wherein said faucet is vertically movable, and wherein said inlet of said faucet moves closer to said upper surface of said tray when said cover overlies said tray.

13. Apparatus according to claim 6, further comprising a rack located beneath said tray and connected to intermediate portions of said legs.

14. Apparatus according to claim 6, wherein said legs are telescoping.

15. Apparatus according to claim 6, wherein said water source is remote from said cart and further comprising a water filtering system connected to said cart.

16. Apparatus according to claim 1, wherein said faucet assumes an upright position when said cover is in said second position and a collapsed position when said cover is in said first position.

17. Apparatus according to claim 16, wherein said faucet is retractably located in said tray, and wherein said inlet of said faucet extends further beneath said upper surface of said tray when said faucet is in said collapsed position than in said upright position.

18. Apparatus according to claim 16, wherein said outlet of said faucet is closer to said upper surface of said tray when said faucet is in said collapsed position than in said upright position.

19. Apparatus according to claim 1, wherein said water filtering system is operably connected to said cart.

20. A portable serving cart/game table comprising:

a mobile cart having a generally horizontal tray with an upper surface and a lower surface, telescoping legs extending from said lower surface of said tray, said legs having upper ends connected to said tray and lower ends, and casters located at said lower ends of said legs, and a cover hingedly connected to said tray of said cart and movable between a first position and a second position, said cover having a top with an outer surface, an inner surface, a front edge, a back edge, and side edges, walls extending from said front, rear and side edges, said walls enclosing said inner surface of said top and forming a storage area therein, and a game board provided on said outer surface of said top;

securing means located in said storage area;

a water delivery system, said system having a faucet extending upward from said upper surface of said tray, said faucet having an inlet and an outlet, an inlet line having a first end connected to a remote water source and a second end connected to said inlet of said faucet, a water filtering system connected to said cart, and a sink positioned in said upper surface of said tray;

where said cover is movable between a first position wherein said cover overlies said upper surface of said tray, and a second position; and wherein said faucet assumes an upright position when said cover is in said second position and a collapsed position when said cover is in said first position.

* * * * *